US005415317A

United States Patent [19]

Hager

[11] Patent Number: 5,415,317

[45] Date of Patent: May 16, 1995

[54] GAS MIGRATION INHIBITOR

[76] Inventor: Ira V. Hager, P.O. Box 5845, Hilton Head Island, S.C. 29938

[21] Appl. No.: 212,140

[22] Filed: Mar. 14, 1994

Related U.S. Application Data

[63] Continuation of Ser. No. 787,644, Nov. 4, 1991.

[51] Int. Cl.[6] ..... B65D 88/34

[52] U.S. Cl. ..... 220/579; 220/216

[58] Field of Search ..... 220/216, 221, 222, 227, 220/578, 579, 580; 222/386, 386.5

[56] References Cited

U.S. PATENT DOCUMENTS

| | | | |
|---|---|---|---|
| 1,417,605 | 5/1922 | Johnston | 220/216 X |
| 1,717,100 | 6/1929 | Downes | 220/216 X |
| 2,556,195 | 6/1951 | Kors | 220/216 X |
| 2,888,717 | 6/1959 | Domitrovic | 220/222 X |
| 3,049,261 | 8/1962 | Wade et al. . | |
| 3,256,977 | 6/1966 | Pettersen | 220/216 X |
| 3,266,662 | 8/1966 | Craig | 220/579 |
| 4,151,910 | 5/1979 | Yasur | 206/216 |
| 4,312,459 | 1/1982 | Leach | 220/256 |
| 4,874,108 | 10/1989 | Valasek . | |

*Primary Examiner*—Allan N. Shoap
*Assistant Examiner*—Nova Stucker
*Attorney, Agent, or Firm*—B. Craig Killough

[57] ABSTRACT

A gas migration inhibitor which lyes on a surface of a material to inhibit the migration of gas from the material. This migration inhibitor has a specific gravity of less than a liquid in which it is placed, floating on a surface of such material within a container in which the liquid material is held, and is non porous so as to inhibit the escape of gas from the material, or the evaporation of the material.

5 Claims, 2 Drawing Sheets

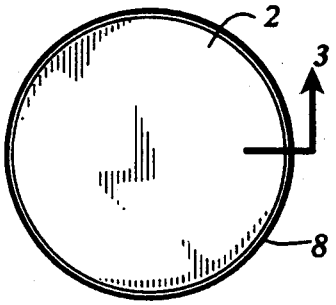
FIG 1
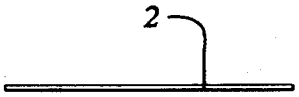
FIG 2
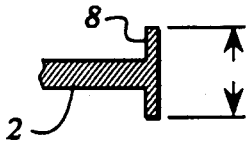
FIG 3
FIG 4
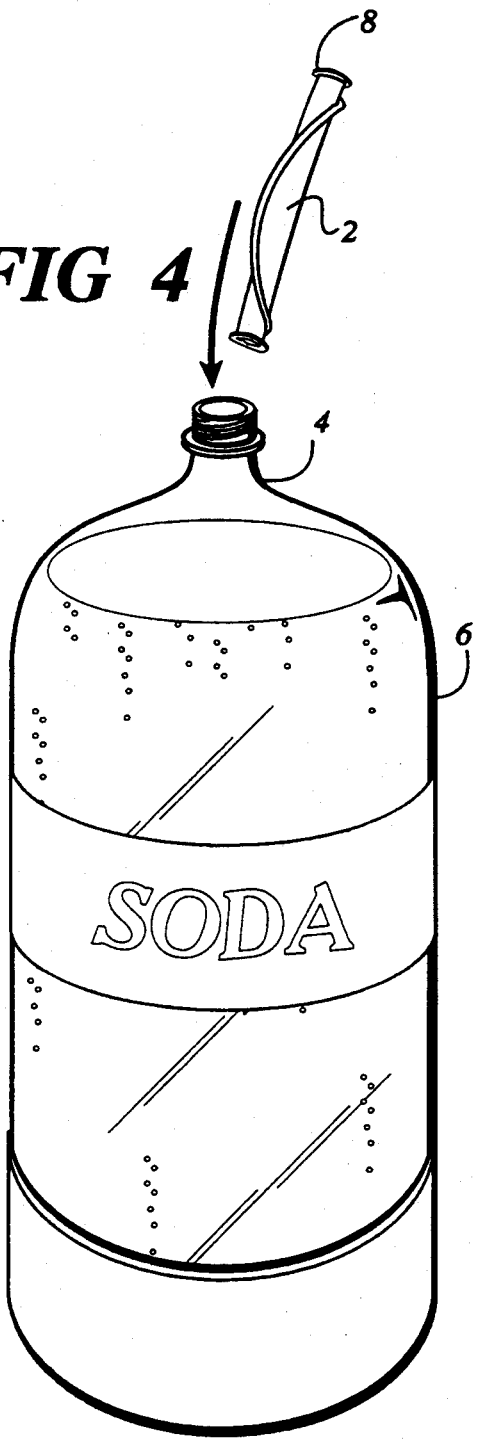
FIG 5
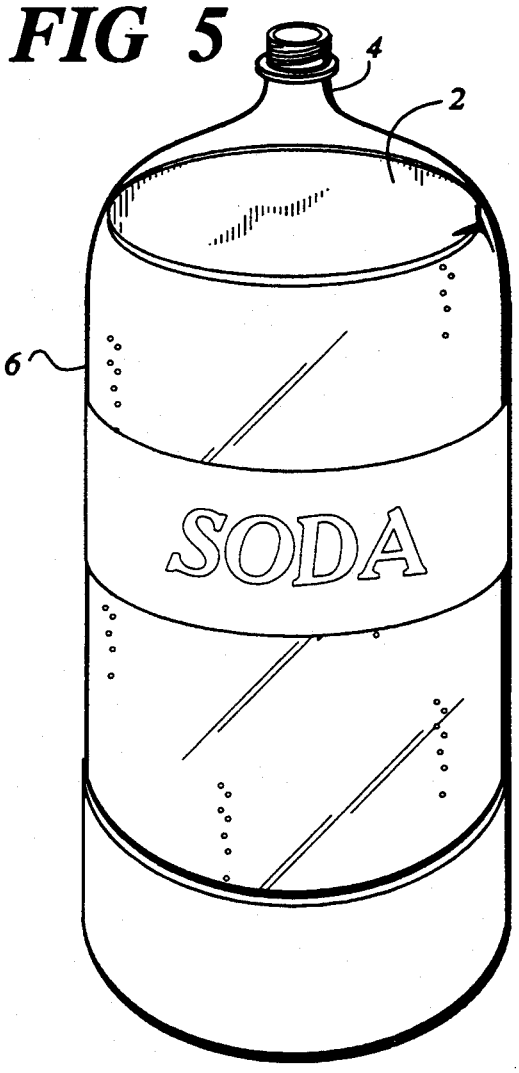

GAS MIGRATION INHIBITOR

This application is a continuation of application Ser. No. 07/787,644 filed Nov. 4, 1991.

BACKGROUND OF THE INVENTION

The present invention is a device which may be placed within a container so as to float or lie on the surface of a material contained within a container to reduce or prevent the container which would normally result from contact by the material with the environment.

Many types of materials are stored within containers of all configurations. Liquids, colloidal substances, semi-solids, and solid materials are placed within containers. These containers are of many types and shapes. They include tanks, drums, bottles, jars, cans, and flasks.

Most containers are provided with a top, lid, cover, or other device which aids in containing the substance, but also aids in preventing the material from exposure to the atmosphere. However, as material is removed from the container, an air space results within the container. Air, or perhaps another gas in certain environments, enters the container, so as to interact within the material contained within the container. Each time the container is opened, the material is exposed to the atmosphere and the air or other gas which enters the container is renewed.

This exposure to the atmosphere as the container is opened, and the entry of air into the container, may have adverse effects on the contents of the container. If the material has a high vaporization rate, accelerated evaporation of the material may result from frequent opening of the container. If the material is a liquid in which a gas has been dissolved, for example, carbonated water, the gas, such as carbon dioxide, will tend to escape from the liquid into the environment. Other materials which are affected by oxidation or are otherwise affected by exposure from air or other environments resulting from exposure to frequent opening and closing of the container can be given as examples.

SUMMARY OF THE PRESENT INVENTION

The present invention is a gas migration inhibitor, which may be used to inhibit the vaporization of the material contained within a container, the release of the gas dissolved within a liquid, or otherwise reduce the effects of exposure of the material within the container to the atmosphere.

If used with a liquid, the gas migration must have a specific gravity of less than the liquid in which it is to be placed. As a result, the device will float on the surface of the material within the container in which the material is stored. The device should have a shape which is slightly less than and which roughly matches the surface of the material within the container, as dictated by the shape and size of the cross section of the container. The device may be of a flexible material which is capable of being rolled or folded to allow insertion of the device through narrow openings, such as a bottle neck. The device may have a lip formed on a perimeter or circumference thereof to further improve the efficacy of the device.

DETAILED DESCRIPTION OF THE DRAWINGS

FIG. 1 is a top, plan view of the gas migration inhibitor.

FIG. 2 is a side elevation of the gas migration inhibitor.

FIG. 3 is a partial sectioned view of the gas migration inhibitor enlarged to emphasize lip 8.

FIG. 4 is a perspective view of a soda bottle, showing as an action view a rolled gas migration inhibitor inserted through the bottle neck of a bottle.

FIG. 5 is a perspective view of a soda bottle with a gas migration inhibitor floating on the surface of the liquid contents of the soda bottle.

DETAILED DESCRIPTION OF THE PREFERRED EMBODIMENT

Figure 6:
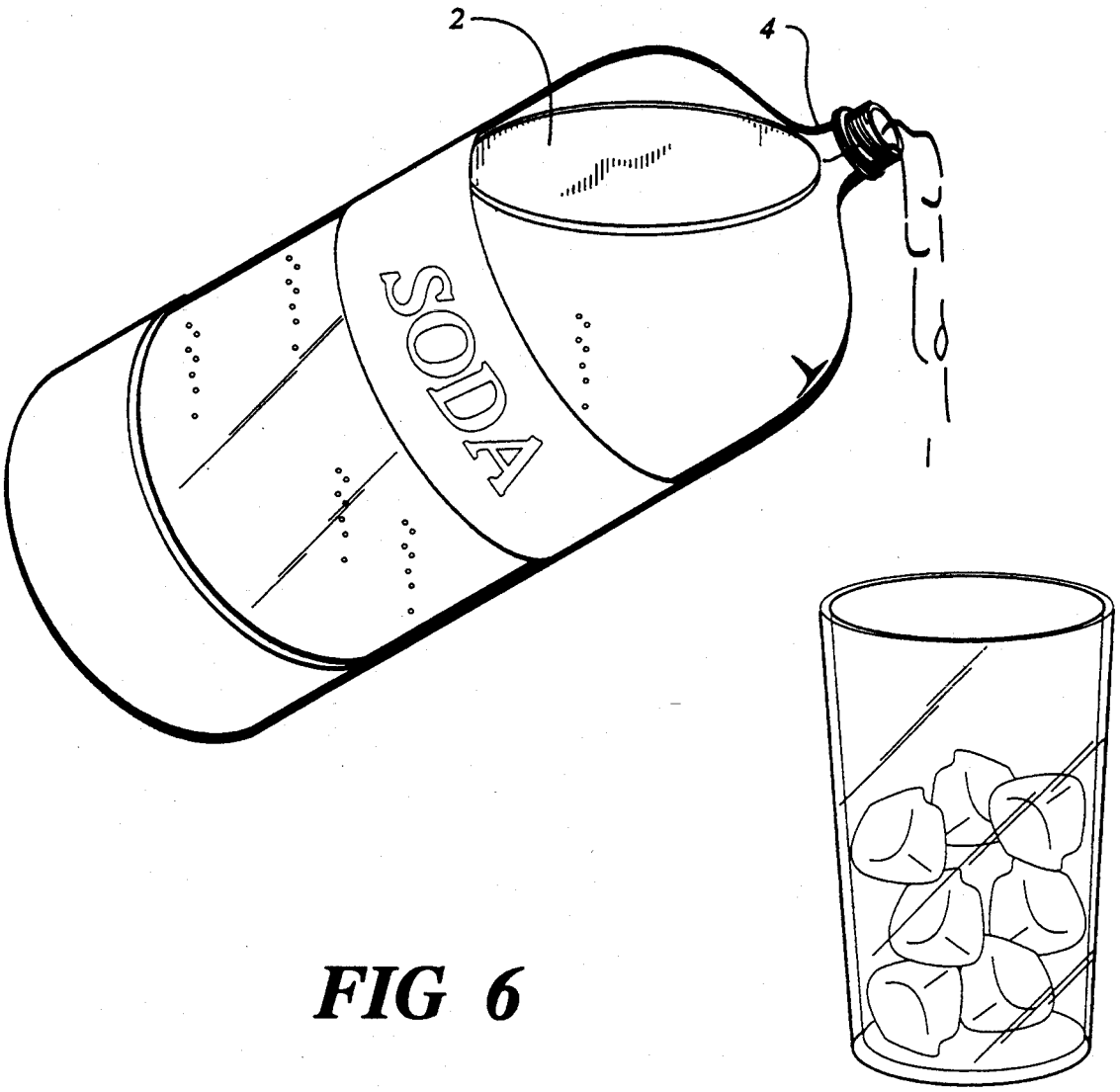
FIG. 6 is a perspective view of a soda bottle with a gas migration inhibitor floating on the surface of the liquid contents of the soda bottle during dispensing of the liquid contents.

The device is characterized by a plane of material having a specific gravity of less than the liquid material into which the gas migration inhibitor is placed. The specific gravity of the device is of no relevance if the device is to be placed over a solid or colloidal substance.

The shape of the device will vary according to the shape of the material which is to be protected. The device should approximate the shape and dimensions of the surface of the material which is contained within the container.

The most common application for the device may be to prevent the escape of carbon dioxide from carbonated beverages. Accordingly, this application is chosen to demonstrate the preferred embodiment. A large bottle of soda, for example, a three liter bottle of soda, is opened and part of the contents poured from the bottle. As the carbonated soda leaves the bottle, it is replaced with air from the atmosphere. Carbon dioxide, which is dissolved within the water and other soda contents, escapes from the carbonated water into the air which is present in the bottle as the liquid contents is removed, even though the bottle is resealed. Each time the bottle is opened and additional liquid is poured from the bottle, new and additional air is introduced into the bottle, further increasing the escape of carbon dioxide from the carbonated water. As a result, if the contents is not used within a relatively short period of time, the contents of the bottle will become "flat".

The gas migration inhibitor is used to float on the surface of the carbonated contents. The device provides a barrier to minimize contact between the carbonated water and the air, as air is increasingly introduced into the bottle as the liquid is removed.

As shown in FIG. 2, the device 2 is characterized by a relatively thin plane of material. If the device is used within a bottle having a circular cross section, as is most commonly the case, the device will be round as shown in FIG. 1.

In the preferred embodiment, the device is constructed of a flexible material which may be rolled or folded as shown in FIG. 4. If the device is to be placed through a bottle neck 4, or other restricted opening, such as the bung of a drum, this characteristic allows the device to be rolled or folded for insertion through the restricted opening.

If the device is to be used in a liquid application, it must have a specific gravity of less than the material which it is used to protect. For example, in the preferred embodiment, the device must have a specific embodiment of less than soda so that the device will float on top of the soda as shown in FIG. 5.

As can be seen in FIG. 5, after the device is inserted into the bottle 6, it regains its original relatively flat shape so as to float on the surface of the liquid material. Its presence over the surface of the liquid material prevents contact by the material with the air which is present in the bottle. In the preferred embodiment, escape of the carbon dioxide which is present in the liquid is retarded by the presence of the device over the surface of the liquid which would otherwise be in contact with the air which is present in the bottle.

The device is constructed of a material having a specific gravity of less than that of the liquid which it is to protect. The material should not be permeable with regard to the particular liquid and/or gas which it is to protect, nor with regard to the atmosphere from which the liquid and/or gas is protected. The particular shape, such as that shown in the top plan view of FIG. 1, may be as required.

The efficacy of the invention is further aided by the use of a lip 8 as shown in FIG. 3. This lip aids in the positioning of the device, as well as aiding in protecting the material. In the preferred embodiment, the lip is present on both the upper and lower surface as demonstrated by FIG. 3, so that as the device is inserted in FIG. 4, the lip contacts the liquid no matter which side of the device is in contact with the liquid. Stated otherwise, each surface of the device is identical so that there is no distinction between an upper and a lower surface.

The device may be used to prevent the migration of a gas dissolved within a liquid: The device may also be used to inhibit the vaporization of liquids, particularly those which are readily vaporized. For example, certain liquid materials, such as those used in medical applications, evaporate quickly, but are very expensive. This device will reduce evaporation of such materials.

The application of the device is not limited to liquid materials contained within common liquid containers, although this is the most likely application. The device can be used in conjunction with any material contained within a container to limit the exposure of the material to the atmosphere as the material is used or removed from the container, and the air of the environment is introduced into the container.

The device may be produced at a relatively low cost, and can be cost justified in most applications.

What is claimed is:

1. A gas migration inhibitor for use with a beverage container having a restricted opening and which is partially filled with a liquid;

said gas migration inhibitor comprising a disc-shaped planar element formed of an impermeable flexible material of a specific gravity chosen for floatation on the liquid, said planar element having a circumferential lip about the periphery thereof, said lip being of unitary construction with said planar element, said lip having a substantially cylindrical outer surface defining the radially outermost surface of said gas migration inhibitor, said outermost surface extending axially from both sides of said planar element, whereby said gas migration inhibitor can be rolled up and inserted through the restricted opening of the container and will unroll to its planar state and float upon the liquid in the container to inhibit the effects of exposure of the liquid to the atmosphere.

2. In combination, a gas migration inhibitor and a beverage container having a restricted opening and which is partially filled with a liquid;

said gas migration inhibitor comprising a disc-shaped planar element formed of an impermeable flexible material of a specific gravity chosen for floatation on the liquid, said beverage container comprising a generally cylindrical lower portion having a generally constant diameter, and having an upper portion which joins said lower portion, wherein said upper portion tapers by means of decreasing diameter from said lower portion along the height thereof to said restricted opening in the top of said beverage container, wherein said restricted opening has a diameter which is substantially less than said diameter of said lower portion of said beverage container, whereby said gas migration inhibitor can be rolled up and inserted through the restricted opening of the container and will unroll to its planar state and float upon the liquid in the container to inhibit the effects of exposure of the liquid to the atmosphere.

3. The combination of claim 2, wherein said liquid is located only in said lower portion of said container and said gas migration inhibitor covers substantially all of the exposed surface of said liquid when said container is in an upright position.

4. In combination, a gas migration inhibitor and a bottle having a restricted opening and which is partially filled with a liquid;

said gas migration inhibitor comprising a disc-shaped planar element formed of an impermeable flexible material of a specific gravity chosen for floatation on the liquid, said bottle comprising a generally cylindrical lower portion having a generally constant diameter, and having an upper portion which joins said lower portion, wherein said upper portion tapers by means of decreasing diameter from said lower portion along the height thereof to said restricted opening in the top of said bottle, wherein said restricted opening has a diameter which is substantially less than said diameter of said lower portion of said bottle, whereby said gas migration inhibitor can be rolled up and inserted through the restricted opening of the bottle and will unroll to its planar state and float upon the liquid in the bottle to inhibit the effects of exposure of the liquid to the atmosphere.

5. The combination of claim 4, wherein said liquid is located only in said lower portion of said bottle and said gas migration inhibitor covers substantially all of the exposed surface of said liquid when said bottle is in an upright position.

* * * * *